United States Patent [19]

Arakawa et al.

[11] 4,386,632

[45] Jun. 7, 1983

[54] WEFT GUIDING COMB FOR A JET LOOM

[75] Inventors: Hiroshi Arakawa, Kariya; Kinpei Mitsuya, Aichi, both of Japan

[73] Assignee: Kabushiki Kaisha Toyoda Jidoshokki Seisakusho, Kariya, Japan

[21] Appl. No.: 170,817

[22] Filed: Jul. 17, 1980

[30] Foreign Application Priority Data

Jul. 19, 1979 [JP] Japan ..... 54-92231

[51] Int. Cl.[3] ..... D03D 47/28

[52] U.S. Cl. ..... 139/435

[58] Field of Search ..... 139/435; 226/97

[56] References Cited

U.S. PATENT DOCUMENTS

| | | | |
|---|---|---|---|
| 3,742,973 | 7/1973 | Kakae | 139/435 |
| 4,125,133 | 11/1978 | Kobayashi et al. | 139/435 |
| 4,136,716 | 1/1979 | Tanaka et al. | 139/435 |

FOREIGN PATENT DOCUMENTS

| | | | |
|---|---|---|---|
| 1269356 | 4/1972 | United Kingdom | 139/435 |

*Primary Examiner*—Henry Jaudon

*Attorney, Agent, or Firm*—Wenderoth, Lind & Ponack

[57] ABSTRACT

A weft yarn guiding comb for a jet loom having a slay, on which the comb is mounted to turn with the slay between a yarn guiding position and a yarn extricating position, includes a plurality of weft yarn guides each comprising a root portion, a substantially straight portion extending upwardly from the root portion, a curved portion branching off from the straight portion while bending to form an aperture in association with the straight portion with an opening between the ends of the straight and corved portions, and a flexible tongue for normally substantially closing the opening. The flexible tongue is provided on the straight portion with its tip positioned either closely adjacent to or in contact with the inner surface of the end of the curved portion thereby to normally close said opening.

7 Claims, 7 Drawing Figures

WEFT GUIDING COMB FOR A JET LOOM

BACKGROUND OF THE INVENTION

This invention relates to a jet loom, in which weft yarns are inserted into a shed by a jet of fluid, and more particularly to a comb comprising teeth with apertures for guiding the insertion of the weft yarns.

In the jet loom of the type described above, the aperture in each tooth is formed in a substantially circular shape so as to surround the weft yarn during the insertion thereof, and has an opening allowing the weft yarn to come out of the aperture therethrough in preparation for the beating of the weft yarn. However, because the fluid injected into the apertures of the teeth is subject to escape from the openings, resulting in a greater consumption of the fluid and the failure of the weft insertion operation, a comb has been designed so as to normally close the openings and only open the same when the weft yarn passes through the openings.

For example, one such prior comb is known from Japanese published and examined patent specification No. 53-27394. This known comb comprises a number of longitudinally spaced teeth or guides 1, only one of which is shown in FIG. 1 for the purpose of simplification. The guide 1 comprises a bifurcated root portion, from which both a substantially straight part 2 and a curved part 3 extend upwardly with a substantially vertically extending opening 4 formed between the inner surface of the end of the straight part 2 and the end surface of the curved part 3. The curved part 3 on the inner surface of the end thereof is provided with a flexible tongue 5 extending toward the inner surface of the end of the straight part and across the opening 4 so as to normally close the opening 4. The guide 1 thus formed in turned downwardly with respect to an inserted weft yarn Y by a (not shown) conventional means so that the center of the aperture in each guide moves in a direction parallel to a line inclined at an angle $\theta$ with respect to a horizontal plane including the inserted weft yarn Y.

It will therefore be appreciated that, upon such movement of the guide 1, the weft yarn Y in the aperture of the guide moves relative to the guide 1, and first comes into contact with the root of the tongue 5 [FIG. 1(*b*)], and then slides on the tongue 5 toward the tip thereof until it bears against the inner surface of the straight part 2 [FIG. 1(*c*)]. Then, the weft yarn is turned upwardly to move out of the aperture of the guide through the opening 4 while making the tongue 5 bend. As shown in FIG. 1(*c*), when the weft yarn Y is in contact with the straight part 2, a force a applied to the weft yarn Y due to the movement of the guide 1 can be divided into a component b perpendicular to the inner surface of the straight part 2, and a component c extending along the inner surface of the straight part 2 and substantially perpendicular to the tongue 5. However, since the component c available to bend the tongue 5 is very small as compared with the component b, the tongue 5 can not be bent easily by the weft yarn Y. This means that the yarn Y is subjected to a great resistance when passing through the opening 4. This great resistance causes a number of small loops or kinks corresponding in number to the tongues 5 to be formed on the weft yarn Y, which has passed through the tongue 5. Such a looped yarn is exaggeratedly shown in FIG. 2, and a cloth woven from the above defective yarns will create a rough feeling.

It is therefore a principal object of this invention to provide a weft yarn guiding comb for a jet loom, in which a tongue can be bent easily by a weft yarn when the latter comes out of the comb, thus removing the disadvantages of the prior art.

SUMMARY OF THE INVENTION

A weft yarn guiding comb for a jet loom generally comprises a plurality of weft yarn guides arranged in equispaced relationship, each guide comprising a substantially straight portion, and a curved portion branching off the straight portion while bending to form an aperture therebetween, for allowing a weft yarn to be inserted through the apertures, with an opening between the ends of the straight and curved portions to allow the inserted weft yarn to come out of the guide. Means are provided for normally substantially closing the opening in each guide. According to this invention, the closing means comprises a flexible tongue provided on the straight portion with its tip positioned closely adjacent to or in contact with the inner surface of the end of the curved portion. The tongue provided on the straight portion can be easily bent by the inserted yarn when it comes out of the guide through the opening.

BRIEF DESCRIPTION OF THE DRAWINGS

The above and further objects and advantages of this invention will become more readily apparent upon reading the description following hereinafter, and upon examination of the drawings, in which.

DESCRIPTION OF THE PREFERRED EMBODIMENTS

Figure 3:
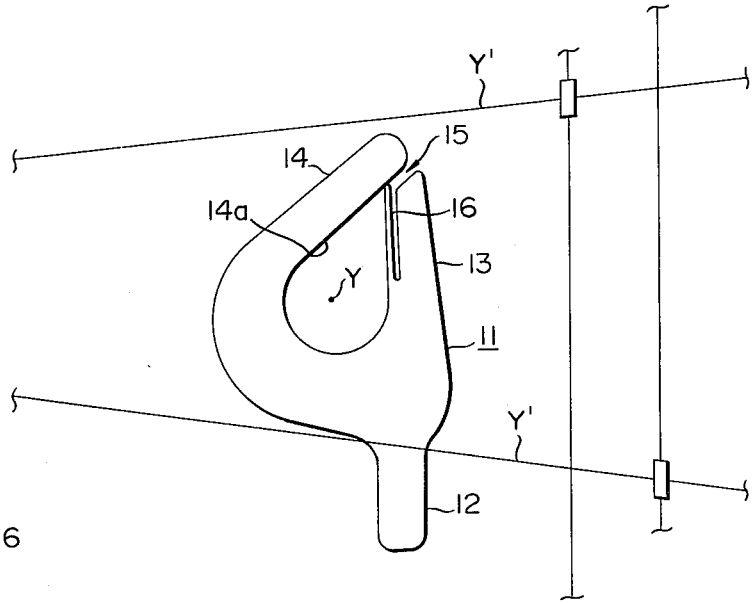
FIG. 3 is a diagrammatic elevational view of a weft guiding comb according to this invention.

Referring to FIG. 3, there is shown one embodiment of this invention, wherein a weft guiding comb comprises a number of weft yarn guides 11 arranged in spaced relationship along the direction in which a weft yarn Y is inserted by a (not shown) conventional means. Each guide 11 has a root portion 12 fixedly supported by a (not shown) slay performing a beating operation, a substantially straight portion 13 upwardly extending from the root portion 12, and a curved portion 14 branching off the straight portion 13 with its lower part bending as shown in FIG. 3 and with its upper part extending substantially straightly over the free end of the straight portion 13 to form a narrow opening 15 between the inner surface 14*a* of the upper part of the curved portion 14 and the top surface of the free end of the straight portion 13.

The above-mentioned surface 14*a* extends in a direction substantially parallel to a line inclined at an angle $\theta$ (FIG. 4) with respect to a horizontal plane including the inserted weft yarn Y. It is to be noted that, to cause the inserted weft yarn Y to come out of the guide 11 through the opening 15, the guide 11 is turned downwardly while moving along the above line inclined at an angle $\theta$. It will therefore be understood that the opening 15 is also inclined substantially at the angle $\theta$.

To normally close the opening 15, a flexible tongue 16 is integrally provided on the inner surface of the straight portion 13, but not the curved portion 14, with its tip positioned either closely adjacent to or in contact with the inner surface 14*a* of the curved portion 14. This tongue 16 has sufficient flexibility to allow the inserted weft yarn Y to easily come out of the guide 11 while bending the tongue 16 against its own elasticity.

Figure 1A:
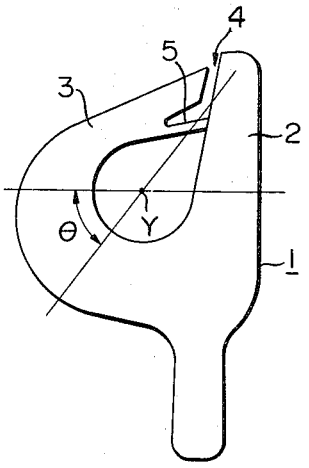
FIG. 1a PRIOR ART
FIGS. 1(*a*) to (*c*) are diagrammatic elevational views of a known weft yarn guide explaining the escape of a weft yarn from the guide.
Figure 1B:
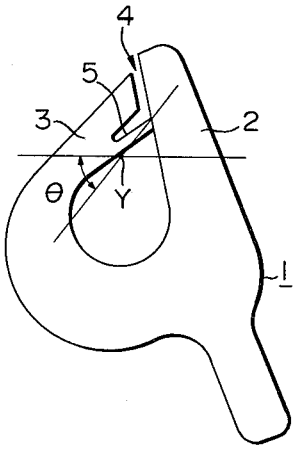
FIG. 1b PRIOR ART
Figure 1C:
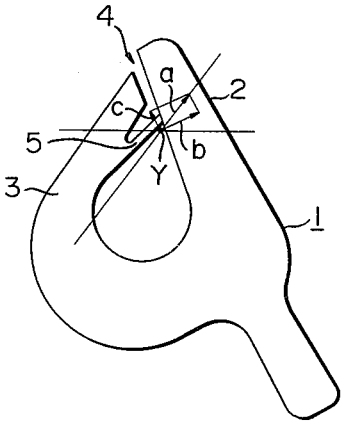
FIG. 1c PRIOR ART
Figure 2:
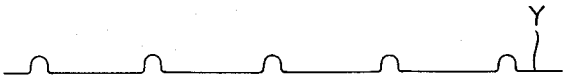
FIG. 2 PRIOR ART
FIG. 2 is a view exaggeratedly showing a defective weft yarn.
Figure 4A:
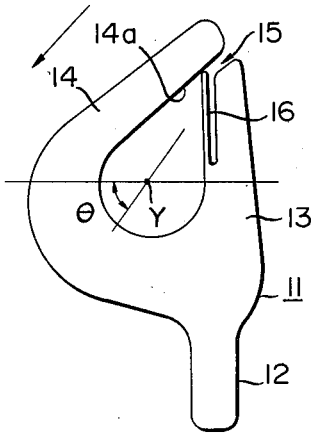
FIGS. 4(*a*) to (*c*) are views, corresponding to FIGS. 1(*a*) to (*c*), explaining the escape of a weft yarn from the comb according to this invention.
Figure 4B:
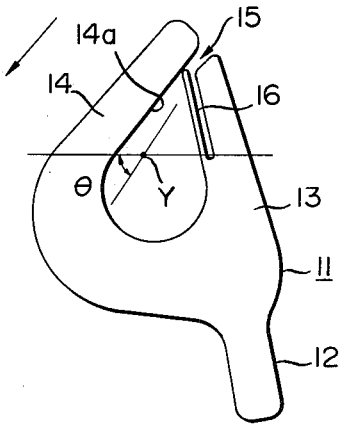
Figure 4C:
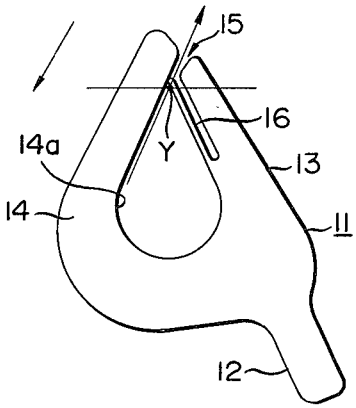

In operation, as shown in FIGS. 4(*a*) to (*c*), the guide 11 is turned downwardly with the center of its aperture moving along a line parallel to the aforementioned line inclined at the angle $\theta$. The yarn Y can directly reach the tip of the tongue 16 without coming into contact with the inner surface 14*a* of the curved portion 14, because the tongue 16 is provided on the straight portion 13 and the inner surface 14*a* is inclined substantially at the angle $\theta$. Therefore, it is not required that the yarn Y make a change of direction when causing the tongue 16 to be bent. This means that the force applied to the yarn Y due to the aforementioned movement of the guide can be effectively used to bend the tongue 16. More specifically, the yarn Y encounters no resistance until it reaches the tip of the tongue 16, and when bending the tongue the force necessary therefor is directly applied to the tip of the tongue 16, which is the most preferrable position to bend the tongue 16. Thus, the yarn Y can easily bend the tongue 16 with little resistance. After passing across the tongue 16, the yarn Y has to pass through the opening 15. As stated previously, since the opening 15 extends substantially parallel to the line along which the center of the aperture of the guide moves, the yarn Y can pass through the opening 15 without a change of direction thereof and without being subjected to resistance by the opening 15. This assures that the jet loom employing the weft guiding comb according to this invention produces a cloth which feels good, because the yarn defect as shown in FIG. 2 can be avoided.

Figure 5:
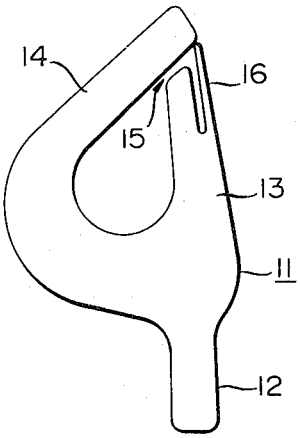
FIGS. 5 to 7 are views showing different modifications of this invention.
Figure 6:
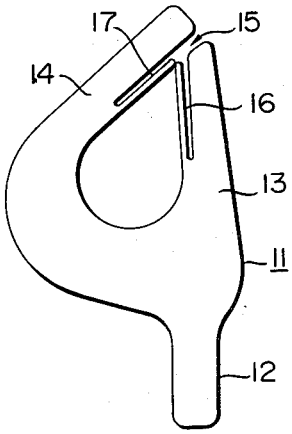

FIG. 5 shows another embodiment of this invention similar to that shown in FIG. 3, except that the tongue 16 is provided on the outer side of the straight portion 13. FIG. 6 shows still another embodiment of this invention, in which both the straight and curved portions 13 and 14 are provided with tongues 16, 17 having their tips positioned either closely adjacent to or in contact with each other to further decrease the possible resistance to the weft yarn imparted thereto when it bends the tongues 16, 17.

Figure 7:
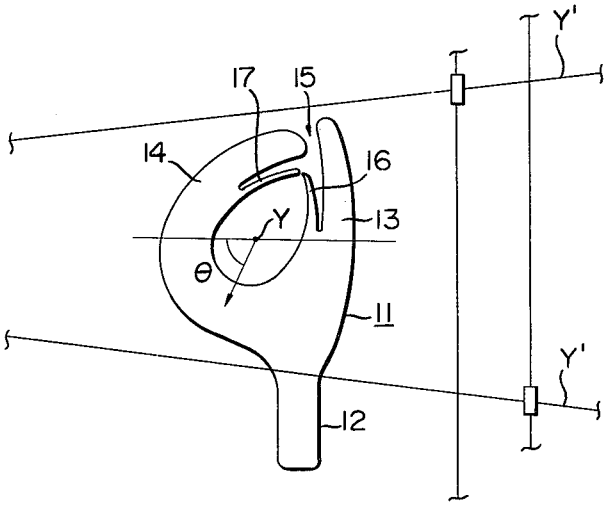

FIG. 7 shows a further embodiment of this invention similar to that of FIG. 6, except that opening 15 is defined between the inner surface of the end of the straight portion 13 and the end surface of the curved portion 14.

These embodiments shown in FIGS. 5 to 7 can operate in substantially the same manner as the embodiment of FIG. 4.

Although various specific embodiments have been described above, it will be readily understood by those skilled in the art that various modifications of parts may be accomplished without departing from the spirit and scope of the invention as defined in the appended claims.

What we claim is:

1. In a weft yarn guiding comb for use in a jet loom of the type having a slay on which said comb is mounted to turn with the slay between a yarn guiding position and a yarn extricating position, said comb comprising a plurality of weft yarn guides each comprising a root portion, a substantially straight portion extending upwardly from said root portion, a curved portion extending upwardly from said straight portion while bending to form an aperture in association with said straight portion with an opening between the ends of said straight and curved portions, and flexible means for normally substantially closing said opening, the improvement wherein:

said end of said straight portion is spaced by said opening from an inner surface of said end of said curved portion; and said flexible means comprises a flexible tongue provided on said straight portion, said tongue having a tip positioned closely adjacent to said inner surface of said end of said curved portion, thereby to normally close said opening.

2. The improvement claimed in claim 1, wherein said tip of said tongue is in contact with said inner surface of said end of said curved portion.

3. The improvement claimed in claim 1, wherein said tongue is provided on the side of the inner surface of said straight portion.

4. The improvement claimed in claim 1, wherein said tongue is provided on the side of the outer surface of said straight portion.

5. The improvement claimed in claim 1, wherein said inner surface of said end of said curved portion extends straightly substantially parallel to a line along which a center of said aperture moves when said comb turns between the yarn guiding position and the yarn extricating position.

6. The improvement claimed in claim 1, wherein said opening extends substantially parallel to a line along which a center of said aperture moves when said comb turns between the yarn guiding position and the yarn extricating position.

7. The improvement claimed in any one of claims 1, 2, 3, 4, 5 or 6, wherein said flexible means is an integral part of said guide.

* * * * *